US010947755B2

(12) United States Patent
Carabalona

(10) Patent No.: US 10,947,755 B2
(45) Date of Patent: Mar. 16, 2021

(54) LATCH MECHANISM WITH STATUS INDICATOR

(71) Applicant: Southco, Inc., Concordville, PA (US)

(72) Inventor: Eric Carabalona, Kenilworth (GB)

(73) Assignee: Southco, Inc., Concordville, PA (US)

( * ) Notice: Subject to any disclaimer, the term of this patent is extended or adjusted under 35 U.S.C. 154(b) by 201 days.

(21) Appl. No.: 16/081,131

(22) PCT Filed: Mar. 2, 2017

(86) PCT No.: PCT/US2017/020372

§ 371 (c)(1),
(2) Date: Aug. 30, 2018

(87) PCT Pub. No.: WO2017/151868

PCT Pub. Date: Sep. 8, 2017

(65) Prior Publication Data

US 2019/0063112 A1 Feb. 28, 2019

Related U.S. Application Data

(60) Provisional application No. 62/303,034, filed on Mar. 3, 2016.

(51) Int. Cl.
*E05B 41/00* (2006.01)
*E05C 3/04* (2006.01)
(Continued)

(52) U.S. Cl.
CPC ..... *E05B 41/00* (2013.01); *E05B 17/0025* (2013.01); *E05C 3/042* (2013.01); *E05C 5/02* (2013.01)

(58) Field of Classification Search
CPC . E05B 41/00; E05B 9/08; E05B 17/00; E05B 17/0025; E05B 65/02; E05B 65/04;
(Continued)

(56) References Cited

U.S. PATENT DOCUMENTS 3,302,964 A * 2/1967 Barry ..... E05C 3/04 292/57
6,640,592 B2 11/2003 Vickers
(Continued)

FOREIGN PATENT DOCUMENTS

CN 85204844 U 12/1986
CN 2661860 Y 12/2004
(Continued)

OTHER PUBLICATIONS

International Search Report and Written Opinion for International Application No. PCT/US2017/020372, dated Jun. 9, 2017—10 pages.

(Continued)

*Primary Examiner* — Suzanne L Barrett
(74) *Attorney, Agent, or Firm* — RatnerPrestia

(57) ABSTRACT

A latch mechanism is provided having a housing, a cap, and at least one indicator. The housing may include a first top surface. The cap may include a second top surface and may be mounted for selective rotational movement relative to the housing between a latched position and an unlatched position. The at least one indicator may be interposed between the cap and the housing and mounted for axial movement relative to the cap. As the cap is rotated from the latched position to the unlatched position, at least a portion of the indicator is axially displaced to an extended position above at least one of the first and second top surfaces.

20 Claims, 6 Drawing Sheets

(51) Int. Cl.
*E05B 17/00* (2006.01)
*E05C 5/02* (2006.01)

(58) Field of Classification Search
CPC . E05C 3/04; E05C 3/042; E05C 3/045; E05C 3/145; E05C 5/02; E05C 5/04
USPC ..... 70/432
See application file for complete search history.

(56) References Cited

U.S. PATENT DOCUMENTS

| | | | | |
|---|---|---|---|---|
| 9,216,747 | B2 | 12/2015 | Matoba et al. | |
| 9,416,569 | B1 * | 8/2016 | Leone | E05C 5/04 |
| 9,845,620 | B2 * | 12/2017 | Bronner | E05B 63/0017 |
| 10,329,799 | B2 * | 6/2019 | Hastings | E05B 39/00 |
| 2008/0000277 | A1 * | 1/2008 | Yu | E05B 35/105 70/432 |
| 2008/0190150 | A1 * | 8/2008 | Hoffmann | E05C 3/042 70/91 |
| 2013/0205848 | A1 * | 8/2013 | Langenberg | E05B 13/004 70/455 |
| 2015/0175174 | A1 | 6/2015 | Matoba et al. | |
| 2015/0240526 | A1 * | 8/2015 | Clary | E05B 15/02 70/432 |
| 2017/0306651 | A1 * | 10/2017 | Hastings | E05C 3/042 |
| 2018/0148958 | A1 * | 5/2018 | Liu | E05B 17/0025 |
| 2019/0338569 | A1 * | 11/2019 | Manly | E05B 17/18 |

FOREIGN PATENT DOCUMENTS

| | | | |
|---|---|---|---|
| CN | 103827418 | | 5/2014 |
| DE | 202004009405 | U1 | 9/2004 |
| DE | 202009004777 | U1 | 10/2010 |
| DE | 202014104058 | U1 | 9/2014 |
| EP | 027553 | A1 | 8/1996 |
| EP | 0727553 | A1 | 8/1996 |
| EP | 2628875 | A1 | 8/2013 |
| GB | 2182381 | A | 5/1987 |

OTHER PUBLICATIONS

Chinese Office Action with Search Report for Chinese Application No. 201780015022.7, dated Feb. 25, 2020, with English Language Summary, 15 pages.

* cited by examiner

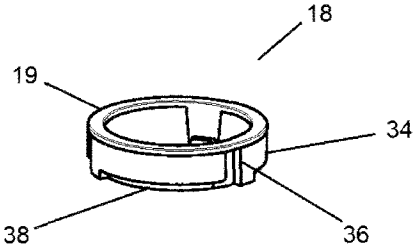
Figure 6A
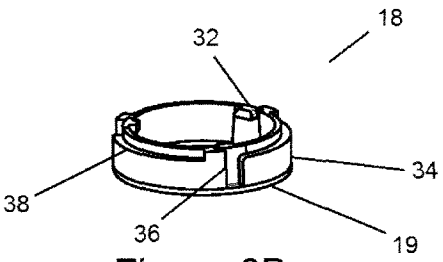
Figure 6B
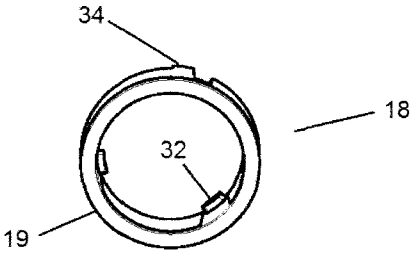
Figure 6C
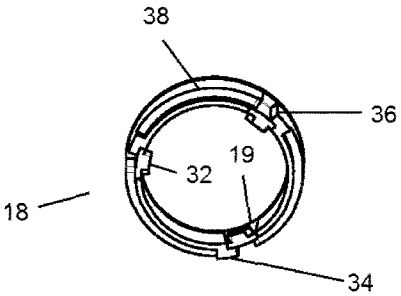
Figure 6D
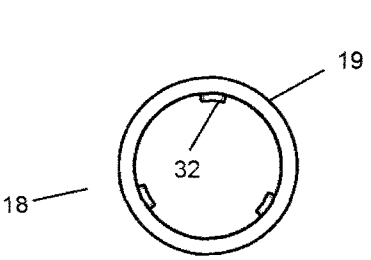
Figure 6E
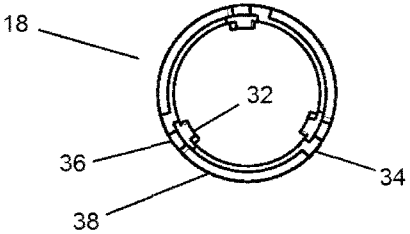
Figure 6F
Figure 6G

LATCH MECHANISM WITH STATUS INDICATOR

CROSS-REFERENCE TO RELATED APPLICATIONS

This patent application is a U.S. National Phase Patent Application of PCT Application No.: PCT/US2017/020372, filed Mar. 2, 2017, which claims priority to U.S. Provisional Patent Application No. 62/303,034, filed Mar. 3, 2016, each of which is incorporated by reference herein in its entirety.

FIELD OF THE INVENTION

The present invention relates generally to latching devices and more particularly to latching devices for securing a first member such as a door, panel or the like in a closed position relative to a second member such as a corresponding door, panel or frame.

BACKGROUND OF THE INVENTION

Various types of latching devices for use in securing a first closure member such as a door, panel or the like in a closed position relative to a corresponding second closure member such as a door, panel or frame are known. Some types incorporate a pawl or similar latching member that is actuated to engage a closure member for latching.

In certain applications, it is desirable to know whether the mechanism is in a latched or unlatched state. For example, latches used to secure the door of a baggage compartment of a coach bus may be inspected prior to beginning a journey. If the latch is not properly locked, the stored luggage belonging to the passengers may be inadvertently lost, if the compartment door opens while in transit, or the baggage may be stolen during the excursion, if the storage compartment is not properly secured and left unattended.

SUMMARY OF THE INVENTION

In one aspect of the present invention, a latch mechanism is provided comprising a housing, a cap, and at least one indicator. The housing may include a first top surface. The cap may include a second top surface and may be mounted for selective rotational movement relative to the housing between a latched position and an unlatched position. The at least one indicator may be interposed between the cap and the housing and mounted for axial movement relative to the cap. As the cap is rotated from the latched position to the unlatched position, at least a portion of the indicator is axially displaced to an extended position above at least one of the first and second top surfaces.

BRIEF DESCRIPTION OF THE DRAWINGS

The above and other aspects and features of the present invention will become more apparent to those of ordinary skill in the art by describing in detail exemplary embodiments thereof with reference to the attached drawings, in which:

FIG. 6*a* is a side perspective view of the top of an indicator of the latch mechanism of FIG. 1*a;*

FIG. 6*b* is a side perspective view of the bottom of the indicator of FIG. 6*a;*

FIG. 6*c* is a top perspective view of the indicator of FIG. 6*a;*

FIG. 6*d* is a bottom perspective view of the indicator of FIG. 6*a;*

FIG. 6*e* is a side view of the indicator of FIG. 6*a;*

FIG. 6*f* is a top plan view of the indicator of FIG. 6*a;*

FIG. 6*g* is a bottom plan view of the indicator of FIG. 6*a;*

DETAILED DESCRIPTION OF THE INVENTION

Figure 1C:
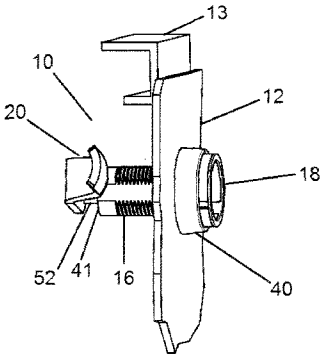
FIG. 1*c* is a side perspective view of the latch mechanism of FIG. 1*a* in an unlatched condition.
Figure 2C:
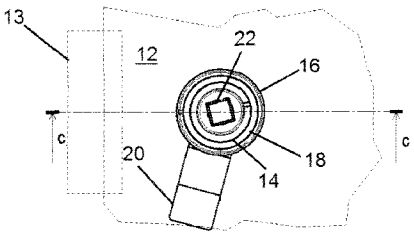
FIG. 2*c* is a top plan view of the latch mechanism of FIG. 1*c;*

The invention will now be described by reference to exemplary embodiments and variations of those embodiments. Although the invention is illustrated and described herein with reference to specific embodiments, the invention is not intended to be limited to the details shown and described. Rather, various modifications may be made in the details within the scope and range of equivalents of the claims and without departing from the invention.

According to various embodiments of the present invention, a latch mechanism is provided that comprises a housing and a cap configured to rotate relative to one another and cause one or more indicators that may, for example, be ring-shaped to extend as the latch mechanism is unlatched. The starting position of the indicator may be located such that the inner and outer circumferential surfaces of the indicator are in a covering relationship to the cap and housing, respectively. In other words, the indicator may be interposed between the cap and housing and, in some embodiments, occupy an annular space between the cap and housing.

As the cap is rotated to the unlatched condition, the indicator may be displaced axially, such that at least a portion of the indicator is no longer in a covering relationship relative to the cap and housing. The indicator may immediately begin to move axially above the top surfaces of at least one of the cap and housing until reaching a fully extended position. Upon reaching the fully extended position, the indicator may maintain this axial position while the cap continues rotation to the fully unlatched position.

The indicators may be provided with a visual enhancement features, such as a bright red color that may be generally visible from a substantial distance, e.g., at least 5 meters away, to warn an operator that the latch is not fully closed, which may be advantageous in some applications, such as on a train or moving vehicle. Springs or other biasing means are optional, but may be included in some embodiments, to facilitate actuation of the indicators. The indicator's motion may be completely controlled by the rotation of the cap or may be controlled by the housing geometry. The cap and/or the housing may remain fixed as the indicator is axially actuated between a withdrawn and extended position. In a preferred embodiment, the cap and the housing remain fixed to maximize the unobscured surface area of the cap in the extended position, which may be provided with the visual enhancement feature and enable the status of the latching mechanism to be easily recognizable.

Referring now to FIGS. 1*a* to 3*c*, a latch mechanism 10 according to a first embodiment of the present invention is provided that may be actuated between a latched and unlatched state. The latch mechanism 10 includes a cap 14 having a square-shaped male portion 22 that corresponds to a driver (not shown), such as a key having a similarly shaped female portion to mate with the cap 14. As would be appreciated by those of skill in the art, other driving means may be used to actuate a latch mechanism made according to the various embodiments of the present invention. For example in applications in which security is not a concern, the driver may be a handle or knob attached to the latch mechanism to eliminate the need for a tool to operate the latch mechanism.

The latch mechanism 10 may further comprise an indicator 18 and a housing 16. The cap 14 may, for example, be mounted for rotational movement relative to the housing 16. One or more indicators 18 may be interposed between the cap 14 and housing 16 at a first end 40 of the housing 16.

Figure 1A:
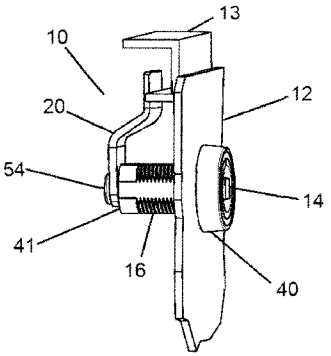
FIG. 1*a* is a side perspective view of a latch mechanism according to an embodiment of the present invention installed in a panel in a latched condition.
Figure 2A:
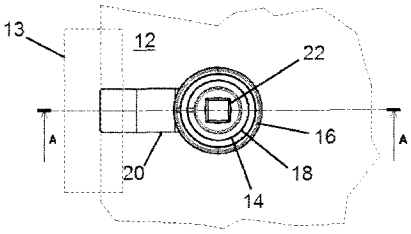
FIG. 2*a* is a top plan view of the latch mechanism of FIG. 1*a;*

In one embodiment of the present invention, the latch mechanism may be provided in the form of a cam latch having a pawl 20. In the latched condition, the pawl 20 is compressed against a catch 13, thereby maintaining the position of the panel 12 relative to the catch 13 (FIGS. 1*a*, 2*a*, and 3*a*). When a user first rotates the cap 14 in a counter-clockwise direction, the pawl 20 initially moves axially away from the catch 13. At the end of the axial displacement of the pawl 20, continuing rotation of the cap 14 causes the pawl 20 to also rotate counter-clockwise, such that the pawl 20 is no longer impeded by the catch 13, thereby allowing a user to pull the panel 12 away from the catch 13 and access an enclosure, for example.

The latch mechanism according to the present invention may be provided in the form of various types of latches, such as a simple cam latch. The inner features of the latch may allow axial and/or rotational movement of the pawl. For example, the cam latch may be configured similar to the latch described in U.S. Pat. No. 6,640,592, the contents of which are incorporated herein by reference in its entirety. For example, the opposing end 41 of the housing 16 relative to the first end 40 may be provided with an opening 50, and a shaft 52, positioned at least in part within the housing 16, may extend through the opening 50. The pawl 20 may be attached to an end of the shaft 52 using a fastening means, such as a screw 54. The outer surface of the housing 16 may also be provided with means to attach the latching mechanism 10 to a panel 12. For example, the means may be in the form of interrupted screw threads 56 along a portion of the outer surface of the housing 16. The screw threads 56 on the outer surface of the housing 16 may be interrupted by two or more flats, preferably at least four flats, formed on the outer surface of the housing 16. The flats formed on the outer surface of the housing 16 prevent the rotation of the housing 16 during actuation of the latch mechanism 10. The interrupted threads 56 on the outer surface of the housing 16 may be engaged by a nut 58 to secure the latch mechanism 10 in the panel 12.

Figure 4:
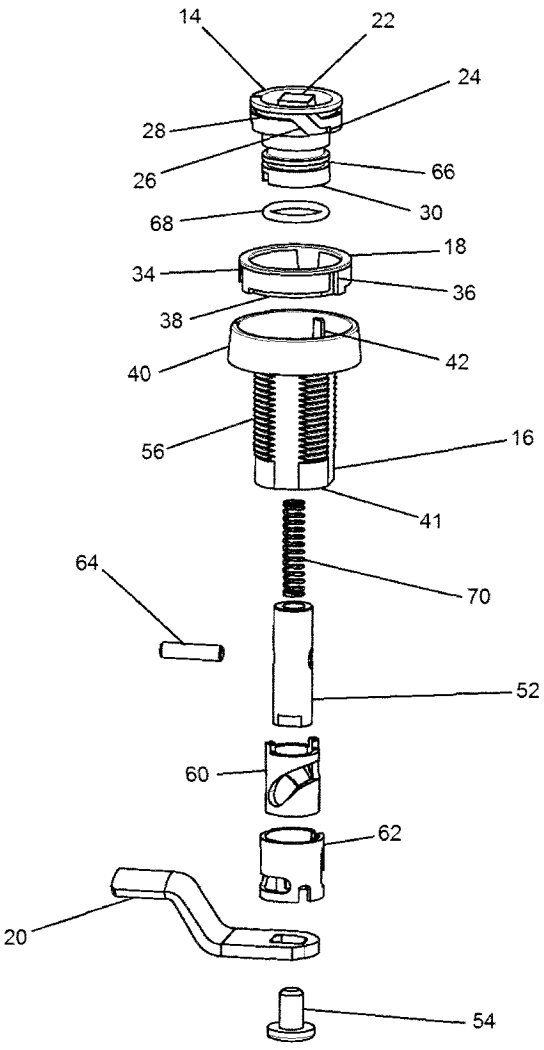
FIG. 4 is an exploded view of the latch mechanism of FIG. 1*a;*
Figure 5A:
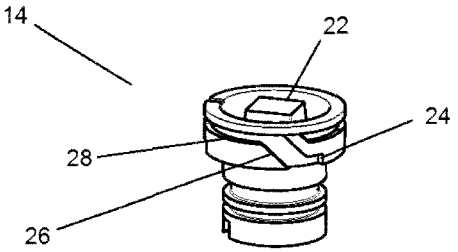
FIG. 5*a* is a side perspective view of the top of a cap of the latch mechanism of FIG. 1*a;*
Figure 5B:
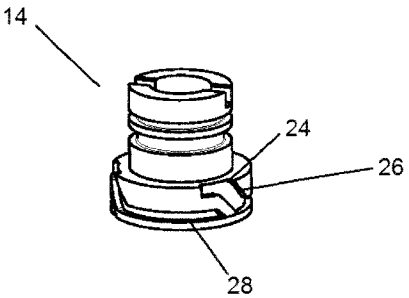
FIG. 5*b* is a side perspective view of the bottom of the cap of FIG. 5*a;*
Figure 5C:
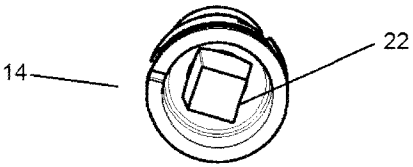
FIG. 5*c* is a top perspective view of the cap of FIG. 5*a;*
Figure 5D:
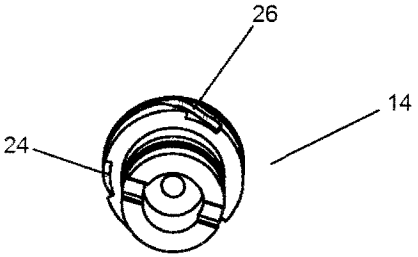
FIG. 5*d* is a bottom perspective view of the cap of FIG. 5*a;*
Figure 5E:
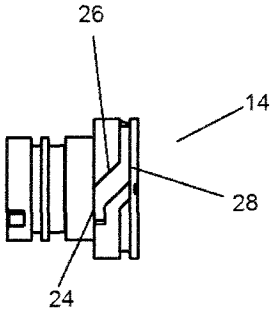
FIG. 5*e* is a side view of the cap of FIG. 5*a;*
Figure 5F:
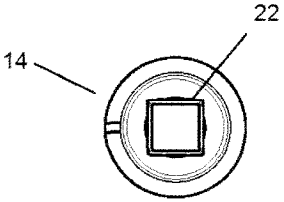
FIG. 5*f* is a top plan view of the cap of FIG. 5*a;*
Figure 5G:
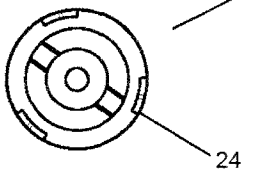
FIG. 5*g* is a bottom plan view of the cap of FIG. 5*a;*
Figure 7A:
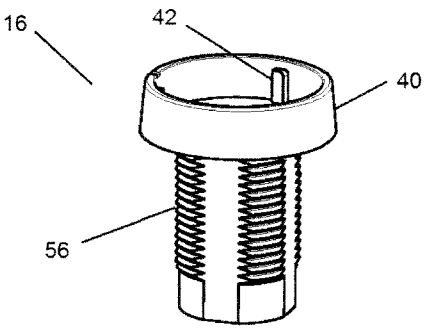
FIG. 7*a* is a side perspective view of the top of a housing of the latch mechanism of FIG. 1*a;*
Figure 7B:
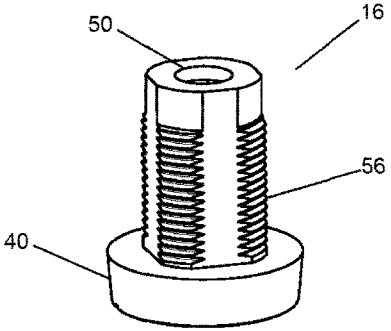
FIG. 7*b* is a side perspective view of the bottom of the housing of FIG. 7*a;*
Figure 7C:
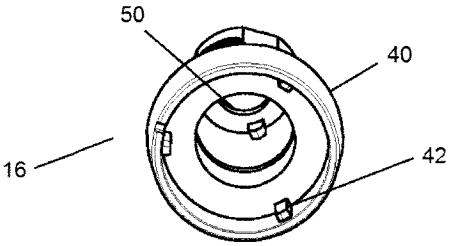
FIG. 7*c* is a top perspective view of the housing of FIG. 7*a;*
Figure 7D:
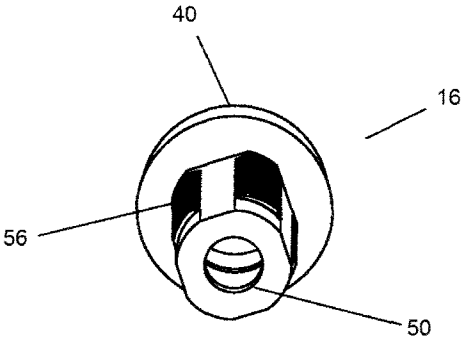
FIG. 7*d* is a bottom perspective view of the housing of FIG. 7*a;*
Figure 7E:
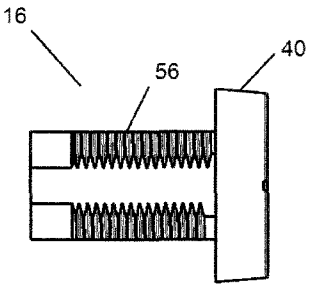
FIG. 7*e* is a side view of the housing of FIG. 7*a;*
Figure 7F:
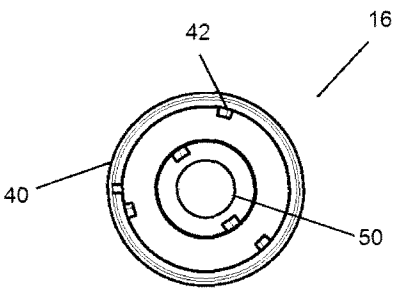
FIG. 7*f* is a top plan view of the housing of FIG. 7*a;*
Figure 7G:
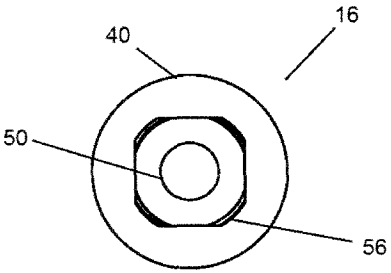
FIG. 7*g* is a bottom plan view of the housing of FIG. 7*a;*

The shaft 52 may be operatively connected to the cap 14. Referring to FIG. 4, this may be accomplished with a set of cam sleeves 60, 62 having cam slots. The inner cam sleeve 60 may be rotatably supported within the housing 16, as well as operatively connected to a lower end 30 of the cap 14, so as to rotate in response to rotation of the cap 14 from the latched condition to the unlatched condition. The outer cam sleeve 62 may remain stationary with the housing 16 during actuation of the latch mechanism. The shaft 52 may include a cam follower 64 located within the cam slots, which may be configured such that the shaft 52 and the pawl 20 rotate in unison and also shift axially away from the end of the housing 16 as the cap 14 moves between the unlatched position and the latched position.

A biasing means, such as a coil spring 70, may be mounted within the shaft 52 to facilitate axial displacement of the shaft 52. The cap 16 may also optionally include an O-ring groove 66 for receiving an O-ring 68 for sealing part of the housing 16 occupied by the cam sleeves 60, 62 from the external environment and prevent, for example, water from entering and freezing within the housing 16, which may damage the latch mechanism.

In order to indicate whether the latching mechanism is in the latched or unlatched condition, the one or more indicators alternate between a withdrawn condition and an extended condition. For example in the withdrawn condition (FIG. 1*a*) in the embodiment provided in FIGS. 1*a*, 2*a*, and 3*a*, the indicator 18 is substantially obscured from view because the cap 14 is occupying an annular space between the cap 14 and the housing 16. The withdrawn condition of the indicator therefore corresponds to the latched condition of the latching mechanism.

As previously noted, the cap 14 may include a square-shaped male portion 22, which mates with a corresponding female portion of a driver. As would be appreciated by those of skill in the art, the male and female portions of the cap and driver may be reversed or provided in a number of shapes, e.g. triangle, hexagon, cross, etc. The cap may also alternatively include a lock plug for receiving a toothed key.

Figure 3C:
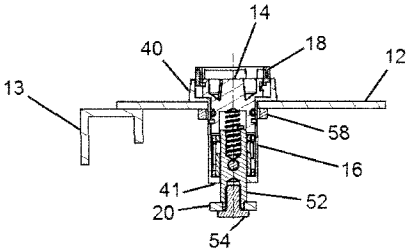
FIG. 3*c* is a side cross-sectional view of the latch mechanism of FIG. 2*c* along axis C-C.
Figure 1B:
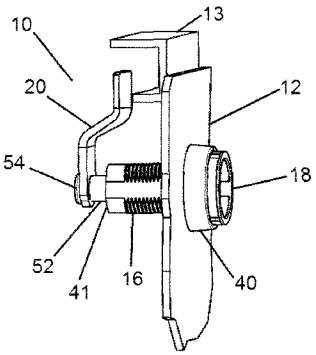
FIG. 1*b* is a side perspective view of the latch mechanism of FIG. 1*a* between a latched and unlatched condition.
Figure 2B:
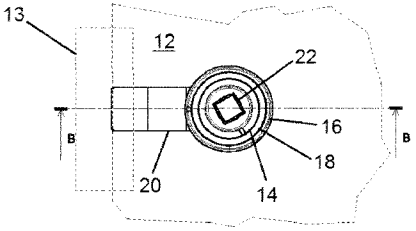
FIG. 2*b* is a top plan view of the latch mechanism of FIG. 1*b;*
Figure 3B:
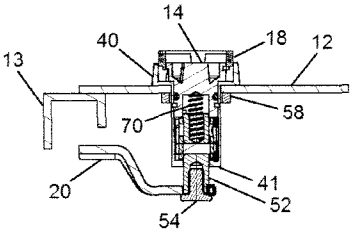
FIG. 3*b* is a side cross-sectional view of the latch mechanism of FIG. 2*b* along axis B-B.
Figure 3A:
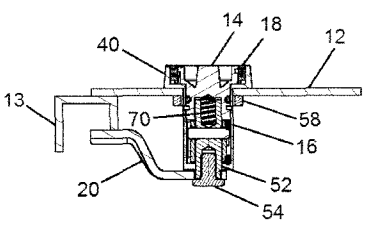
FIG. 3*a* is a side cross-sectional view of the latch mechanism of FIG. 2*a* along axis A-A.

As provided in FIGS. 3*a*, 3*b*, and 3*c*, the cap 14 has been rotated approximately 195 degrees, for example, to the unlatched condition (FIG. 3*c*), axially displacing the indicator 18 to the extended position above the top surfaces of the cap 14 and housing 16, such that at least a portion of the inner and/or outer circumferential surfaces of the indicator 18 is no longer obscured. Accordingly, in the unlatched condition, at least a portion of the inner and/or outer circumferential surfaces of the indicator 18 are visible.

The portion of the indicator may include a visual enhancement feature. For example, in embodiments in which the indicator is ring-shaped, the visual enhancement feature may be applied to the inner and/or outer circumferential surfaces of the indicator 18. The visual enhancement feature can be a color, a light, a reflector, or any other indicator means that enhances visualization of the indicator. It is preferred that the portion of the indicators that are no longer obscured be provided with a color that is different than the color of the cap and/or housing, such that the indicators when extended are easily recognizable.

Figure 8B:
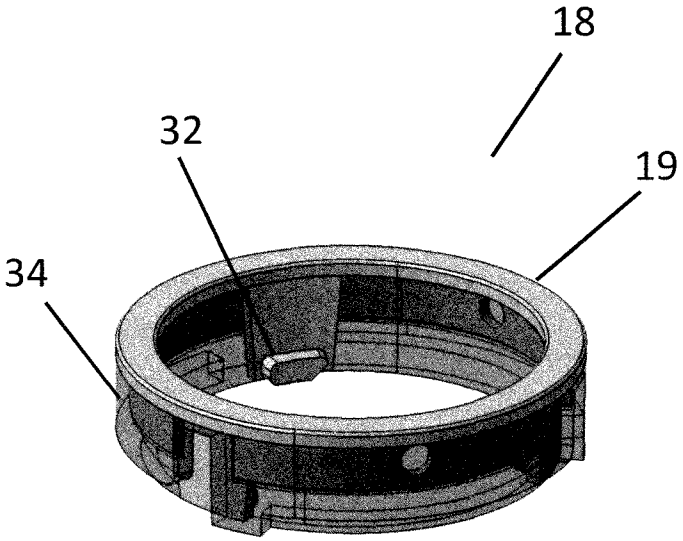
FIG. 8*b* is an overmolded base portion of FIG. 8*a* wherein the overmold is translucent.
Figure 8A:
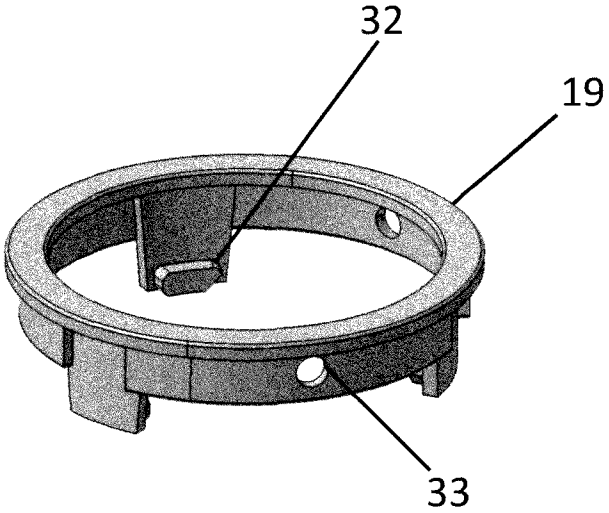
FIG. 8*a* is a base portion of the indicator of FIG. 6*a*.

For example, in a preferred embodiment illustrated in FIGS. 8*a* and 8*b*, the indicator 18 includes a base portion 19 that may be overmolded with a colored plastic 34. The base portion 19 may include a plurality of holes 33 in order to encapsulate at least a portion of the base portion 19 with plastic and secure the overmolded plastic 34 to the base portion 19. The overmolded plastic 34 may comprise the portion of the indicator that is colored differently than the cap and/or housing and is visible in the extended position. Other means may be incorporated in a latch mechanism according to the present invention for allowing a user to easily recognize that at least a portion of the indicator is in the extended position. For example that indictor may include a light, such as an LED, or a fluorescent or phosphorescent paint may be applied to at least a portion of the indicator, such that it is illuminated in the extended position. The extended position in this embodiment corresponds to the unlatched condition; however, if desired, the correlation between the position of the indicators and the latched and unlatched conditions of the latching mechanism may be reversed.

In order to cause the one or more indicators to transition from a withdrawn position to an extended position when the cap is rotated, one embodiment of the present invention may include a cam arrangement and a guide arrangement. The cam arrangement may include one or more cam grooves in an outer circumferential surface of the cap, and the guide arrangement may include L-shaped slots in the outer circumferential surface of the indicator.

Referring to FIGS. 5*a* to 6*g*, the cap 14 may include one or more cam grooves 24 having a ramp section 26 and a plateau section 28. A lower end of the indicator 18 may be provided with one or more cam followers 32 on the inner circumferential surface of the indicator 18. Each of the cam followers 32 may be positioned within one of the cam grooves 24. In a preferred embodiment, the indicator 14 may include three cam followers 32 spaced approximately equally, i.e. every 120 degrees, about the inner circumferential surface of the indicator with each cam follower 32 having a corresponding cam groove 24.

As would be appreciated by those of skill in the art, the position of the cam followers and cam grooves may be reversed in some embodiments of the invention, such that the cam followers are located on an upper end of the outer circumferential surface of the cap and the cam grooves provided on the inner circumferential surface of the indicator.

Referring now to FIGS. 6*a* to 7*g*, the outer circumferential surface of the indicator 18 may also include one or more L-shaped grooves having a vertical/axial portion 36 and a horizontal/circumferential portion 38. Also, an inner circumferential surface in an upper portion 40 of the housing 16 may be provided with one or more ribs 42. Each of the ribs 42 may be positioned within one of the L-shaped grooves. In a preferred embodiment, the housing 16 may include three ribs 42 spaced approximately equally, i.e. every 120 degrees, about the inner circumferential surface with each rib 42 having a corresponding L-shaped groove.

As would be appreciated by those of skill in the art, the position of the ribs and L-shaped grooves may be reversed in some embodiments of the invention, such that the ribs are located on an outer circumferential surface of the indicator and the L-shaped grooves provided on the inner circumferential surface of the housing. The direction of the cam grooves and L-shaped grooves may also be reversed, such that rotation in the opposite direction will actuate the indicator.

During actuation of the embodiment of the present invention illustrated in the various figures, the axial position of the cap 14 relative to the housing 16 is substantially constant. Therefore, the movement of the cap 14 during actuation of the latch mechanism 10 consists only of rotational movement and does not move axially relative to the housing 16. This feature is beneficial in that the operator of the latch mechanism 10 will be able to cause rotational movement of the cap 14 without axial movement of the cap 14 toward or away from the operator. An axially sliding cap that simultaneously rotates between a latched and unlatched condition may feel awkward for a user, for example, when using a driver to operate the latching mechanism.

After rotating the cap 14 counter-clockwise relative to the housing 16, the ramp sections 26 of the cam groove 24 meet a respective cam follower 32 urging the axial displacement of the indicator 18. The ribs 42 are positioned within vertical sections 36 of the L-shaped grooves and prevent rotation of the indicator 18. Axial displacement continues during rotation of the cap 14 until the cam followers 32 reach the plateau sections 28 of the cam grooves 24. Upon reaching the end of the plateau section 28 of the cam groove 24, the indicator 18 may now rotate counter-clockwise with the cap 14 because the ribs 42 are no longer constrained within the vertical section 36 of the L-shaped groove and instead may travel along the horizontal section 38. Rotating the cap 14 in the clockwise direction will cause axial displacement of the indicator 18 back to the original withdrawn position when the cam followers 32 again meet the ramped sections 26 of the cam grooves 24 and urge the indicator 18 down into the annular space between the cap 14 and housing 18.

It is preferred that the indicator 18 is in the extended position for a majority of the angle of rotation of the cap 14. As would be appreciated by those of skill in the art, the angle of the ramped section 26 and length of the plateau section 28 of the cam groove 24 may be modified to control the timing of axial displacement of the indicator 18 during actuation of the latch mechanism. For example, reducing the angle of the ramped section 26 will require more angular rotation of the cap 14 to transition from the withdrawn position to the fully extended position. In order to facilitate the urging of the indicator 18 from the withdrawn to the extended position, a corner of the cam follower may be removed to increase the contact surface area with the cam follower meets the ramped section of the cam groove during rotation of the cap.

In the present embodiment, the components of the latch mechanism are preferably comprised of metal and metal alloy materials, however, other suitable materials can also be used where desired, such as plastic. In addition, in the present embodiment, the closure member can be comprised of any suitable materials, such as wood or metal, and can be of varying thickness.

While preferred embodiments of the invention have been shown and described herein, it will be understood that such embodiments are provided by way of example only. Numerous variations, changes and substitutions will occur to those skilled in the art without departing from the spirit of the invention. Accordingly, it is intended that the appended claims cover all such variations as fall within the spirit and scope of the invention.

We claim:

1. A latch mechanism comprising:

a housing having a first proximal surface;

a cap having a second proximal surface and mounted for selective rotational movement relative to the housing between a latched position and an unlatched position; and at least one indicator interposed between the cap and the housing, the at least one indicator being mounted for axial movement relative to the cap as the cap is rotated from the latched position to the unlatched position such that at least a portion of the indicator is axially displaced to an extended position relative to at least one of the first and second proximal surfaces, a guide arrangement associated with the housing or the cap and the at least one indicator and configured to guide movement of the housing or the cap and the at least one indicator relative to one another, wherein the guide arrangement is configured such that rotation of the at least one indicator relative to the housing is prevented during rotation of the cap between the latched and unlatched positions until the at least one indicator is in the extended position, and, once the at least one indicator is in the extended position, rotation of the at least one indicator relative to the housing is permitted during rotation of the cap between the unlatched and latched positions.

2. The latch mechanism of claim 1, wherein the cap is configured to receive a driver for turning the cap from the latched position to the unlatched position.

3. The latch mechanism of claim 1, wherein the cap is mounted within the housing and the at least one indicator is positioned within an annular space defined between the cap and the housing.

4. The latch mechanism of claim 1, further comprising a cam arrangement associated with the cap or the housing and the at least one indicator and configured to guide movement of the cap or the housing and the at least one indicator relative to one another.

5. The latch mechanism of claim 4, wherein the cam arrangement comprises one or more cam followers positioned within one or more cam grooves and the cam grooves are configured to cause the axial movement of the at least one indicator during rotation of the cap between the latched and unlatched position.

6. The latch mechanism of claim 5, wherein the one or more cam followers are provided on the cap and the one or more cam grooves are provided on the at least one indicator.

7. The latch mechanism of claim 5, wherein the one or more cam followers are provided on the at least one indicator and the one or more cam grooves are provided on the cap.

8. The latch mechanism of claim 1, wherein the guide arrangement comprises one or more ribs positioned within one or more slots.

9. The latch mechanism of claim 8, wherein one or more ribs are provided on the housing and the one or more slots are provided on the at least one indicator.

10. The latch mechanism of claim 8, wherein one or more ribs are provided on the at least one indicator and the one or more slots are provided on the housing.

11. The latch mechanism of claim 1, wherein the least one indicator is ring-shaped.

12. The latch mechanism of claim 1, wherein the portion of the at least one indicator includes a visual enhancement feature.

13. The latch mechanism of claim 12, wherein the visual enhancement feature is selected from the group consisting of a color, a light, and a reflector.

14. The latch mechanism of claim 12, wherein the least one indicator is ring-shaped.

15. The latch mechanism of claim 14, wherein the visual enhancement feature is provided on at least one of an outer circumferential and an inner circumferential surface of the at least one indicator.

16. The latch mechanism of claim 15, wherein the visual enhancement feature is provided on the outer circumferential and the inner circumferential surfaces.

17. The latch mechanism of claim 12, wherein the visual enhancement feature comprises overmolded plastic.

18. The latch mechanism of claim 1, wherein movement of the cap relative to the housing during rotation between the latched and unlatched positions consists of the selective rotational movement.

19. The latch mechanism of claim 1, wherein the latch mechanism is configured to prevent or limit axial movement of the cap relative to the housing during rotation between the latched and unlatched positions.

20. The latch mechanism of claim 1 further comprising:

a shaft positioned at least in part within the housing, the shaft extending through an opening in a bottom surface of the housing, the shaft being operatively coupled to the cap such that the shaft moves rotationally as the cap moves between the unlatched position and the latched position.

* * * * *